US009539784B2

(12) United States Patent
Demuss

(10) Patent No.: US 9,539,784 B2
(45) Date of Patent: Jan. 10, 2017

(54) METHOD AND DEVICE FOR PRODUCING PAPER OR CARDBOARD BOX LIDS AND/OR BOX BOTTOMS

(75) Inventor: Lutz Demuss, Landau (DE)

(73) Assignee: Mohrbach Verpackungsmaschinen GmbH, Rieschweiler-Muehlbach (DE)

( * ) Notice: Subject to any disclaimer, the term of this patent is extended or adjusted under 35 U.S.C. 154(b) by 1166 days.

(21) Appl. No.: 13/544,673

(22) Filed: Jul. 9, 2012

(65) Prior Publication Data

US 2012/0289390 A1 Nov. 15, 2012

Related U.S. Application Data

(63) Continuation of application No. PCT/EP2010/005202, filed on Jan. 7, 2010.

(30) Foreign Application Priority Data

Jan. 7, 2010 (WO) ..... PCT/EP2010/000032

(51) Int. Cl.
*B31B 1/12* (2006.01)
*B31B 1/62* (2006.01)
(Continued)

(52) U.S. Cl.
CPC . *B31B 1/28* (2013.01); *B31B 1/34* (2013.01); *B31B 17/00* (2013.01);
(Continued)

(58) Field of Classification Search
CPC ..... B31B 2217/082; B31B 1/32; B31B 2201/024; B31B 2201/0276; B31B 2201/2604; B31B 2201/2612; B31B 2201/2629; B31B 2201/2654; B31B 2217/06; B31B 3/00
(Continued)

(56) References Cited

U.S. PATENT DOCUMENTS 1,664,739 A 4/1928 Deline
2,240,445 A 4/1939 Thaxton
(Continued)

FOREIGN PATENT DOCUMENTS

DE 10 2005 054 982 A1 7/2007
DE 20 2006 014 009 U1 9/2007
DE 10 2006 028 824 A1 11/2007

*Primary Examiner* — Gloria R Weeks
*Assistant Examiner* — Eyamindae Jallow
(74) *Attorney, Agent, or Firm* — Muncy, Geissler, Olds & Lowe, P.C.

(57) ABSTRACT

A method and device for producing boxes from paper or cardboard is provided. The boxes include a cut-out shape in the form of the bottom or the lid, with a lateral wall stuck thereto. The lateral wall is formed from a strip having a beginning, an end, and connection tongues are bent by up to 90° C. Then, the beginning of the strip is applied and fixed to the lateral surface of a cylindrical female mold having a cross-section corresponding to the cross-section of the box, by means of a male mold. Then, the female mold is turned. The strip is sucked onto the lateral surface and held in place by means of a vacuum. After an adhesive has been applied to the beginning or end of the strip, the beginning and end of the strip are stuck together. Then, a cut-out shape in the form of the bottom or the lid, which has previously had adhesive applied to the periphery thereof, is pressed onto the connection tongues. Once the adhesive has hardened and the vacuum has been stopped, the finished box can be removed from the female mold.

13 Claims, 2 Drawing Sheets

(51) Int. Cl.
*B31B 1/28* (2006.01)
*B31B 1/34* (2006.01)
*B31B 17/00* (2006.01)

(52) U.S. Cl.
CPC ..... *B31B 2201/2604* (2013.01); *B31B 2201/2629* (2013.01); *B31B 2217/06* (2013.01); *B31B 2217/082* (2013.01)

(58) Field of Classification Search
USPC ..... 493/101, 102, 105, 123, 128, 143, 144,493/145, 152, 153, 158
See application file for complete search history.

(56) References Cited

U.S. PATENT DOCUMENTS 2,238,256 A * 4/1941 Engel ..... B31B 17/00 229/116.2
2,637,252 A * 5/1953 Swisher ..... B31B 17/00 493/84
3,107,587 A * 10/1963 Tipton ..... A21B 3/131 156/290
3,513,757 A * 5/1970 Di Frank ..... B31B 1/00 493/131
3,643,554 A 2/1972 Lippman
4,170,172 A * 10/1979 Wommelsdorf ..... B31B 1/28 493/296
4,194,440 A * 3/1980 Gorig ..... B31B 1/28 493/105
4,208,955 A * 6/1980 Doll ..... B31B 1/28 493/102
4,395,253 A 7/1983 Goodman
4,490,129 A * 12/1984 Oakley ..... B31B 1/46 493/129
4,581,003 A * 4/1986 Ito ..... B31B 43/00 493/102
5,385,526 A * 1/1995 Sigrist ..... B31B 1/36 493/123
5,400,917 A * 3/1995 Stanton ..... B65D 3/10 220/612
5,992,489 A * 11/1999 Busse ..... B31B 1/32 156/443
2001/0009883 A1* 7/2001 Couturier ..... B26D 5/02 493/123
2002/0140151 A1* 10/2002 Couturier ..... B65H 23/245 270/58.07
2003/0093977 A1* 5/2003 Brizzi ..... B65B 19/228 53/444
2004/0248718 A1* 12/2004 Stanton ..... B31B 1/62 493/150
2009/0280973 A1* 11/2009 Graham ..... B31B 1/36 493/127
2010/0216617 A1* 8/2010 Demuss ..... B31B 1/34 493/128

* cited by examiner

METHOD AND DEVICE FOR PRODUCING PAPER OR CARDBOARD BOX LIDS AND/OR BOX BOTTOMS

This nonprovisional application is a continuation of International Application No. PCT/EP2010/005202, which was filed on Aug. 24, 2010, and which claims priority to International Patent Application No. PCT/EP2010/000032, which was filed on Jan. 7, 2010, and which are both herein incorporated by reference.

BACKGROUND OF THE INVENTION

Field of the Invention

The invention relates to a method for producing paper or cardboard box lids and/or box bottoms with a lid or bottom blank and a sidewall attached thereto. It relates further to devices for producing box parts of this type.

Description of the Background Art

The production of paper or cardboard boxes with a cubic form with the use of fully automatic box erecting machines has already been worked out very well. The production of boxes with a non-cubic form, particularly when the cross section of the boxes has at least one concave section and at least one convex section, continues to be problematic, however. Boxes of this type are described, for example, in DE 20 2006 014 009 U1 and in DE 10 2006 028 824 A1 and DE 10 2005 054 982 A1. The production of these boxes occurs so that an elongated paper or cardboard strip forming the sidewall is glued onto the base made of paper or cardboard. For this purpose, the paper or cardboard strip has a length that corresponds to the periphery of the base. Connecting tabs, which are connected to the strip by a bending line, are formed on the long side of the strip forming the sidewall.

To produce these boxes, the strip forming the sidewall is first glued to form a ring. The connecting tabs are then folded inward. Next, this ring is placed manually on a form, which corresponds to the desired box shape, and fixed in place. Subsequently, the base is glued onto this shaped ring. After removal of the glued unit, a so-called interior mirror, which covers the connecting tabs, is then glued in.

Because the described production method is essentially manual work, it is not very efficient. This is unsatisfactory.

Other machines for producing heart-shaped boxes are described in U.S. Pat. Nos. 1,664,739, 2,240,445, and 3,643,554. U.S. Pat. No. 4,395,253 describes a machine for producing boxes made of corrugated cardboard.

SUMMARY OF THE INVENTION

It is therefore object of the present invention to provide a method with the help of which paper or cardboard boxes can be produced fully automated with a regular or with an irregular cross section.

This object is achieved by a method including the features: providing a strip with a beginning, an end, and connecting tabs on a long side as the sidewall, bending the connecting tabs by up to 90 degrees, placing the strip against the lateral surface of a cylindrical female mold, whose cross section corresponds to the cross section of the box, with the aid of a male mold, connecting the strip beginning and strip end, placing the lid or bottom blank on the connecting tabs, connecting the connecting tabs to the lid or bottom blank, temporary fixing of the strip beginning to a section of the female mold, rotating the female mold, whereby the strip is suctioned onto the lateral surface of the female mold and held in place by means of a vacuum, and after the connecting tabs are connected to the lid or bottom blank, breaking of the vacuum and removing of the finished box part from the female mold.

A first advantage of the method of the invention is the complete elimination of manual work, because the entire process proceeds completely automatically. A second advantage is that during rotation of the female mold the strip is placed precisely not only against the convex or protrusion but also against possibly present concave sections or recessed sections of the female mold, whereby the placing can be supported by the male mold, and also remains applied during further rotation of the female mold. The male mold also guarantees the correct zero positioning of the female mold, the correct positioning of the strip beginning on the female mold, the placing of the strip in the concave sections or recessed sections of the female mold cross section, and finally the proper gluing of the beginning and end of the strip.

According to an embodiment of the invention, in the case of boxes with more than one concave or recessed and convex or protruding section, the "placing" and "rotating" steps are repeated as often as corresponds to the number of concave sections or recessed sections along the box periphery. This means that the method is suitable for boxes whose cross section corresponds to a heart, a star, a comet, a Christmas tree, etc.

Devices for the fully automated production of box parts of this type are also the subject of the invention.

This object is attained by means of devices including the features: a cylindrical female mold, whose base area corresponds to the shape of the box to be produced; a male mold, which is movable in at least one axis; openings, which can be connected to a vacuum source and in this manner hold the strip against the female mold, are provided in the lateral surface of the female mold; the female mold is mounted rotatably; and the male mold has an active surface, which cooperates with the lateral surface of the female mold and in this manner brings the strip closer or applies it to the female mold, until the vacuum acts.

Due to the combined actions of the male mold and female mold, the paper or cardboard strip, forming the sidewall, is suctioned by the vacuum nozzles against the lateral surface of the female mold, held in place, and shaped until the box bottom or lid has been glued on. This process occurs program-controlled within a very short time without an operator having to assist manually.

It is understood that the precise feeding of the strip to the female mold is particularly important. For this reason, according to a refinement of the invention, there is a device in front of the female mold for the precise feeding of the strip to the female mold.

Furthermore, the female mold can be placed upstream of a device that bends the connecting tabs on the long side of the paper or cardboard strip, preferably by 90 degrees.

According to an embodiment of the invention, a stop can also be provided, which positions the beginning of the strip precisely relative to the female mold. Said stop can be realized as a light barrier.

To keep the necessary vacuum performance as low as possible, according to a refinement of the invention, the openings in the lateral surface are divided into groups, it being possible to connect each group to the vacuum source via a controlled vacuum connection.

Advantageously, the height of the lateral surface is matched to the height of the strip. This provides optimal positioning of the strip forming the box sidewall.

According to an embodiment of the invention, suction openings are also provided in the base area of the female mold. With the aid of these suction openings, a possibly to-be-provided interior mirror can be held in position until the strip forming the sidewall is wound and the adhesion created.

Pressure sensors in the lines from the vacuum source to the suction nozzles in the female mold can be turned on to monitor the proper placing of the strip on the female mold. If the strip is not applied correctly, the suction nozzles draw in air and the pressure increases, which is measured and reported by the pressure sensors.

According to an embodiment of the invention, the female mold is attached removably to an axis of rotation, whereby the axis of rotation is simultaneously the vacuum rotary feedthrough. In this way, the vacuum tubes interfering with rotary movement are unnecessary and the female mold can be rotated endlessly.

According to an embodiment of the invention, the male mold is a traveling ram with a blade-like face, whose cross section is matched to the concave section or recessed section of the female mold. In other words, the face is formed in such a way that the strip during insertion into the concave sections or recessed sections is bent if necessary but naturally not detached.

It is understood that female and/or male molds are advantageously replaceable to be able to produce boxes of various shapes and sizes without long changeover times.

Advantageously, adhesive nozzles are provided for applying adhesive to the strip beginning or strip end, box bottom, box lid, and/or connecting tabs.

According to an embodiment of the invention, the female mold is assigned a device for pressing the adhesive-coated box bottom or lid onto the sidewall formed from the strip, the connecting tabs, and/or a possible interior mirror.

In order to improve the positioning of the strip on the female mold, a guide edge may be provided on the lateral surface.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
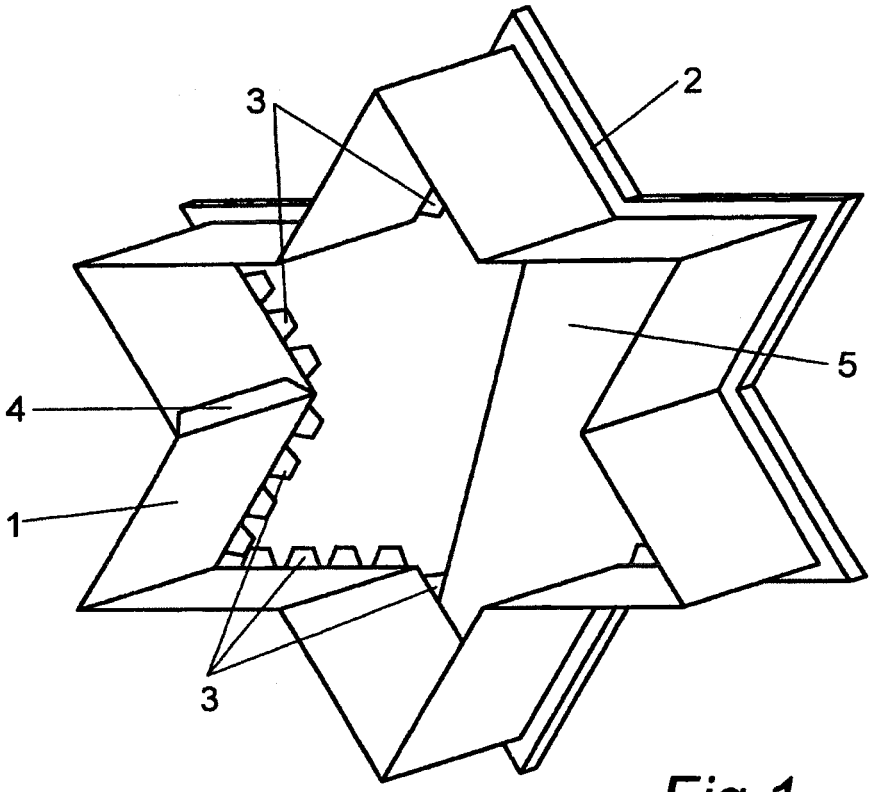
FIG. 1 shows a lower part of a box with a star shape.

FIG. 1 shows purely schematically the bottom part of a paper or cardboard box with a star shape. Box shapes of this type are often used for chocolates. Boxes may also have the shape of a Christmas tree, Santa Claus, an Easter bunny, an Easter egg, an apple, or also a heart. All of these box shapes have in common that they cannot be produced with box erecting devices that are known and have proven to be effective for cubic boxes.

As FIG. 1 shows, the depicted bottom box part has a bottom blank 2 made of paper or cardboard, on which there is a sidewall, having a paper or cardboard strip 1, which is glued to form a ring by means of overlapping at strip beginning 4 and is then glued onto bottom blank 2. Connecting tabs 3 are provided for gluing. It is also possible however to glue strip 1 in a butt-joint manner to base 2. If connecting tabs 3 are not to be visible, a so-called interior mirror 5 (only shown in areas) is glued in.

Figure 2:
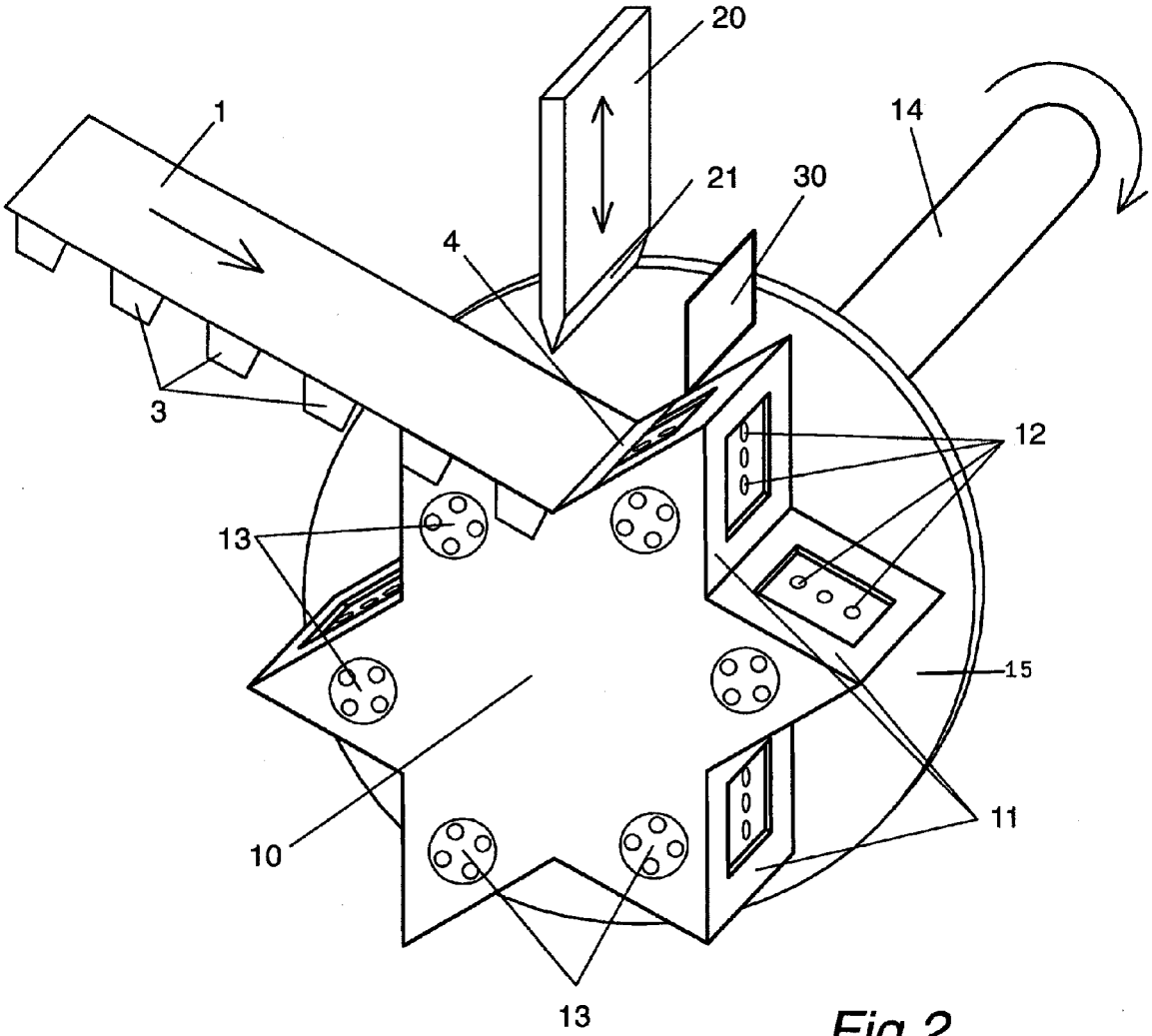
FIG. 2 shows the elements of a device for producing the star-shaped paper or cardboard boxes according to FIG. 1.

The apparatus illustrated purely schematically in FIG. 2 for the production of the bottom box part shown in FIG. 1 has a female mold 10 and a male mold 20 as the major components.

Female mold 10 forms the heart of the device. A cylinder is evident whose base area corresponds to box 1, 2 to be produced; therefore it is also star-shaped. Openings 12 are provided in areas in lateral surface 11 of female mold 10. These can be connected to a vacuum source (not shown) via vacuum connections. It is possible in this way to shape strip 1 into a sidewall by means of vacuum at lateral surface 11 of female mold 10 and to fix it in position until bottom blank 2 is glued on. A guide edge 15 guarantees the exact position of strip 1 along female mold 10.

The production of a matching box lid occurs basically in the same manner. Nevertheless, a female mold with matching dimensions must be used. Therefore, it is of great advantage that female molds 10 can be quickly replaced.

To be able to detect whether strip 1 lies correctly on lateral surface 11 and closes openings 12, pressure sensors can be inserted into the vacuum lines. If the nozzles suck in air, the low pressure in the line drops, which is detected by the pressure sensors and reported.

As can be seen in FIG. 2, strip 1 with already folded down connecting tabs 3 is pushed forward until strip beginning 4 encounters a stop 30. Male mold 20 then travels downward and positions strip beginning 4 precisely in one of the recessed sections of the star-shaped female mold 10. There, strip beginning 4 is held in place by a vacuum nozzle.

Next, female mold 10 is turned with the help of its connecting axis 14, to which it is attached replaceably. In so doing, strip 1 is wound onto lateral surface 11 and shaped. If necessary, the winding and shaping are supported by male mold 20 traveling back and forth in a controlled manner.

As soon as strip 1 has been wound totally onto female mold 10, the end of the strip is pressed against strip beginning 4 with the help of male mold 20, until the previously applied adhesive has hardened. It is basically possible to apply the adhesive as a continuous bead to bottom blank 2 and/or interior mirror 5. It is substantially better, however, when the adhesive is applied precisely metered in a punctiform manner to the front and/or back side of connecting tabs 3; however, because of the plurality of connecting tabs 3 and the high working speed of modern machines, this imposes high requirements on hardware and software.

Next, a bottom blank (not shown) can be removed from a tray in a manner known per se with the aid of a vacuum arm. Said bottom blank is now pressed with the help of the arm onto female mold 10, connecting tabs 3, and strip 1, forming the sidewall, until the previously applied adhesive has hardened. Next, the completed box is removed from female mold 10 with the help of the same or different vacuum arm, whereby the removal process is supported in that air is blown out of vacuum nozzles 12, 13.

Vacuum nozzles 13 provided in the base of female mold 10 have the task of holding in place interior mirror 5, which is placed on female mold 10, before strip 1 has been wound onto lateral surface 11.

The supplying of the vacuum to vacuum nozzles 12, 13 occurs through a vacuum rotary feedthrough integrated into the axis of rotation 14.

The trays, which stock the blanks for the sidewall, bottom, and interior mirror, are not shown in the drawing. The devices that remove the blanks from the trays and supply them to the processing stations are likewise not shown. The vacuum source is also not shown. These functional elements are realized by conventional technology. Their illustration would make the drawing unclear and thereby incomprehensible.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A device for producing paper or cardboard box lids and/or box bottoms with a lid or bottom blank and a sidewall attached thereto in a fully automated process, the device comprising:

a paper or cardboard strip to be shaped into the sidewall of the box to be produced;

a rotatable female mold that corresponds to a shape of the sidewall of the box to be produced;

a male mold, which is movable in at least one axis;

vacuum openings, which are connectable to a vacuum source and in this manner hold the strip against the female mold as the female mold rotates, and are provided in lateral surfaces of the female mold, wherein the male mold has an active surface, which cooperates with the lateral surfaces of the female mold and in this manner brings the strip closer to and places the strip against the vacuum openings of the female mold as the female mold rotates to modify the strip into the box shape, and wherein the male mold is a traveling ram with a face, whose cross section is matched to a recessed section of the female mold.

2. The device according to claim 1, wherein a device is arranged in front of the female mold for the precise feeding of the strip to the female mold.

3. The device according to claim 1, further comprising a device that is configured to bend the connecting tabs and that is configured to be connected upstream of the female mold.

4. The device according to claim 1, further comprising a stop configured to position a beginning of the strip with respect to the female mold.

5. The device according to claim 4, wherein the stop is a light barrier.

6. The device according to claim 1, wherein the vacuum openings in the lateral surfaces of the female mold are divided into groups, and wherein each group is connectable to the vacuum source via a controlled vacuum connection.

7. The device according to claim 1, further comprising suction openings that are arranged in a first base area of the female mold.

8. The device according to claim 1, further comprising pressure sensors arranged in lines from the vacuum source to the female mold.

9. The device according to claim 1, wherein the female mold is attached removably to an axis of rotation, and wherein the axis of rotation is a vacuum rotary feedthrough.

10. The device according to claim 1, wherein adhesive nozzles are provided for applying an adhesive.

11. The device according to claim 1, wherein a guiding edge for the strip is arranged on a second base area of the female mold.

12. The device according to claim 1, wherein the cross section of the face of the male mold corresponds to the base of the recessed section.

13. The device according to claim 1, wherein a shape of the female mold is irregular.

* * * * *